United States Patent [19]

Poe, Jr. et al.

[11] Patent Number: 4,715,456

[45] Date of Patent: Dec. 29, 1987

[54] SLIPS FOR WELL PIPE

[75] Inventors: Frank E. Poe, Jr.; Dan R. Schwertner; Cooper L. Dunn; Melvyn F. Whitby, all of Houston, Tex.

[73] Assignee: Bowen Tools, Inc., Houston, Tex.

[21] Appl. No.: 832,315

[22] Filed: Feb. 24, 1986

[51] Int. Cl.[4] ..... E21B 19/10

[52] U.S. Cl. ..... 175/423; 188/67

[58] Field of Search ..... 175/422 WS; 188/67

[56] References Cited

U.S. PATENT DOCUMENTS

| | | | |
|---|---|---|---|
| 2,340,597 | 2/1944 | Kelley | 188/67 |
| 2,545,627 | 3/1951 | Moore | 188/67 |
| 3,097,409 | 7/1963 | Kelley | 188/67 |
| 3,140,523 | 7/1964 | Taylor, Jr. | 188/67 |
| 3,571,865 | 3/1971 | Johnson | 188/67 |
| 3,579,752 | 5/1971 | Brown | 188/67 |
| 3,742,562 | 7/1973 | Haby | 188/67 |
| 3,748,702 | 7/1973 | Brown | 188/67 |
| 4,306,339 | 12/1981 | Ward | 188/67 |
| 4,381,584 | 5/1983 | Coyle, Sr. | 188/67 |

OTHER PUBLICATIONS

Cavins Advance Spiders Model "C"; Section 200; p. 24A and Instructions Section 200; p. 24B.

*Primary Examiner*—James A. Leppink
*Assistant Examiner*—Hoang C. Dang
*Attorney, Agent, or Firm*—Pravel, Gambrell, Hewitt, Kimball & Krieger

[57] ABSTRACT

A hydraulically actuated slip assembly having a slip pivotally connected at its sides by parallel links to the side surfaces of a slip block with slip engaging surfaces which allow the slip to be engaged and disengaged from tubing or pipe and operated within a reduced area. An alternative embodiment utilizes a floating die to allow the parallel links to disengage the slip from the pipe in a compact configuration.

18 Claims, 8 Drawing Figures

SLIPS FOR WELL PIPE

FIELD OF THE INVENTION

This present invention relates to a new and improved slip assembly specifically adapted for use in workover and snubbing operations on petroleum wells.

BACKGROUND OF THE INVENTION

In the oil industry, "slips" have been necessary elements of oil field drilling equipment for many years. Classic slips are sets of heavy hinged blocks with gripping dies that are positioned in a slip bowl of a rotary table to engage drill pipe or casing. Angled surfaces in each slip block mate with angled surfaces in the slip bowl. The angled surfaces cause axial forces exerted by the pipe on the blocks to be transferred into lateral gripping pressure on the pipe to support the pipe and thus prevent it from slipping through the slips.

As is well known in the art, classic slips are engaged by oilfield personnel called "roughnecks" who physically maneuver the heavy slips into the slip bowl so that they slide into engagement with the casing or drill pipe. The slips are disengaged by upward axial movement of the casing or drill pipe to take the weight of the pipe off the slips. The slips are then lifted out of the slip bowl to disengage them from the casing or drill pipe and permit their removal from the slip bowl if desired.

Physical movement of slips by personnel is somewhat dangerous and time-consuming. Mechanical equipment to move the slips has also been utilized in the past to alleviate the manual handling. So far as is known, when such mechanically activated slips are disengaged from the pipe, the slips allowed the pipe to be run in and out of the hole, but would not open wide enough to allow the passage therethrough of oversized components with the pipe, such as packers and collars, without time-consuming disassembly of the slips. Thus, prior slip designs have had undesirable limitations.

Slips are also used in hydraulic workover units and snubbing rigs for well service operations. Workover rigs are portable, light weight and are generally used to control the injection and removal of tubing in a well. A snubbing unit is a special kind of workover rig which is suited to well workover where the well is under pressure. Snubbing units control negative and positive forces on the pipe as it is lowered or removed from the well which is under pressure. Because a snubbing unit is capable of handling tubing subject to forces in both axial directions, it typically utilizes four sets of slips, two of which grip and hold the pipe in each axial direction.

SUMMARY OF THE INVENTION

The present invention relates to a new and improved slip assembly wherein the slip travel is mechanically controlled, requires a minimum of axial space for operation, and provides a full bore opening for the passage of collars, packers, or other parts and equipment with the pipe which are larger in diameter than the pipe, without disassembly of the slips or removal of the slips from the slip bowl. Additionally, a plurality of slip bowl segments are provided, one segment for each of the slips. More specifically, the slip assembly has parallel linkage arms which connect each of the slips to a corresponding slip bowl segment or block so that the slip can be translated away from the pipe while maintaining the slip die in parallel relation to the axis of the pipe. In the preferred embodiment, each slip block has offset or stepped surfaces for engaging a slip so that each slip is moved laterally when translated a minimum amount axially. Preferably, three or four slips and slip blocks to engage drill pipe are mounted radially with respect to the axis of the well bore.

An alternative embodiment of the invention utilizes a slip block without stepped engaging surfaces. Such embodiment includes a two-piece slip which has an inner portion which floats or slides along an outer portion of the slip.

BRIEF DESCRIPTION OF THE DRAWINGS

For a further understanding of the nature and objects of the present invention, reference should be made to the following detailed description, taken in conjunction with the accompanying drawings in which the parts are given like reference numerals and wherein.

DETAILED DESCRIPTION OF THE PREFERRED EMBODIMENT

Figure 1:
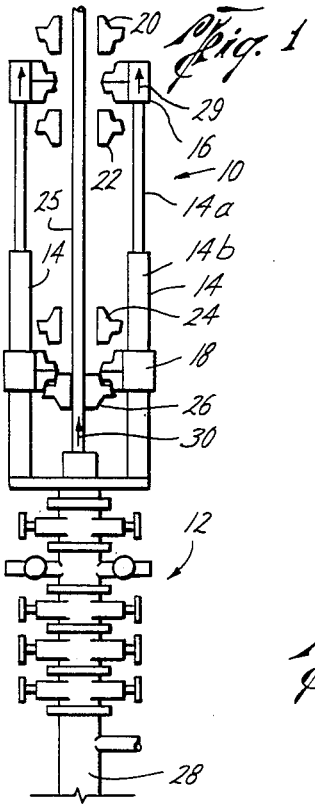
FIG. 1 is a view of a well head on which the frame of a typical hydraulic workover or snubbing unit is mounted, illustrating a lower slip assembly in gripping engagement with a positive upward force on the pipe due to well pressure, and an upper slip assembly disengaged from the pipe.

Because many varying and different embodiments may be made within the scope of the inventive concept taught herein, and because many modifications may be made in the embodiments detailed herein, it is to be understood that the details herein are to be interpreted as illustrative and not in a limited sense.

FIGS. 1 through 4 illustrate the operation of slips in a conventional hydraulic snubbing or workover unit. The snubbing or workover rig in FIGS. 1 through 4 is generally designated by the numeral 10. The snubbing unit 10 is mounted on a well head 12. Because snubbing units are portable, are erected on the well head, and use the well head as a means of support, snubbing units are made as compact and light weight as possible. Snubbing unit 10 has a pair of hydraulic cylinders 14 and piston rods 14a therewith which extend and retract to raise and lower the pipe 25 in the hole, as will be more evident hereinafter. An upper slip assembly 16 is affixed to the piston rods 14a and a lower slip assembly 18 is affixed to the hydraulic cylinders 14. The upper slip assembly has top slips 20 and bottom slips 22, and the lower slip assembly 18 has top slips 24 and bottom slips 26, which grip the pipe selectively as necessary to raise and lower pipe 25 into and out of the well bore through the well head 12, as is well known.

Since the operation of the snubbing apparatus is well known, a brief description of such operation will suffice to illustrate the equipment with which the slip assemblies of this invention are utilized. FIG. 1 illustrates the position of the apparatus wherein the rods 14a are extended and the lower slips 26 are set in gripping engagement with the pipe 25 to prevent the well pressure from forcing the pipe 25 upwardly.

Figure 2:
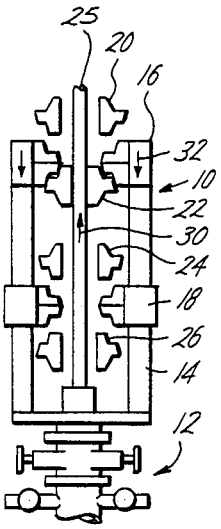
FIG. 2 is a view similar to FIG. 1, but illustrating the upper slip assembly closed in gripping engagement with the pipe, and the lower slip assembly opened so that the pipe is forced downwardly into the well bore against upward force on the pipe from well pressure.

FIG. 2 shows the position of the apparatus after the bottom slips 22 of the upper slip assembly 16 have been closed and the bottom slips 26 of the lower slip assembly 18 have been opened so that extensible rods 14a can be moved downwardly in the hydraulic cylinders 14 to force the pipe 25 downwardly into the well bore 28 against the well pressure indicated by the upward arrow 30. The downward movement of the rods 14a is depicted by arrows 32. Upon completion of the downward stroke, the bottom slips 26 in the lower slip assembly 18 are closed (not shown) to hold the pipe 25 in position, and the bottom slip 22 of upper slip assembly 16 are opened (not shown). This allows the upward movement of the extensible rods 14a to move the upper slip assembly 16 up the pipe 25 to the position of FIG. 1 so that another section of pipe 25 corresponding to the downward stroke of the rods 14a can thereafter be forced downwardly into the well bore 28.

Figure 3:
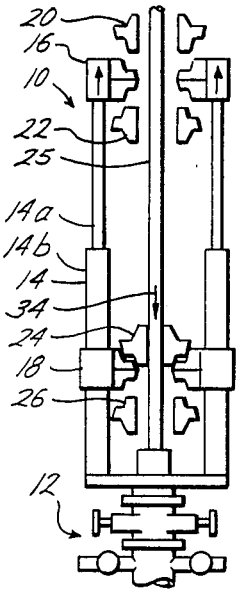
FIG. 3 is a view similar to FIG. 2, but illustrating the upper slip assembly in an open position and the lower slip assembly in a closed position gripping the pipe when the weight of the pipe is exerting a downward force sufficient to overcome any well pressure, so that drill pipe is supported to prevent downward movement.
Figure 4:
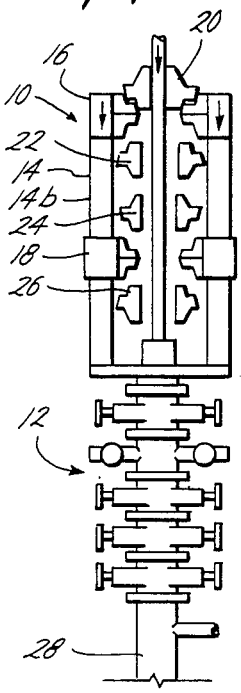
FIG. 4 is a view similar to FIG. 3, but illustrating the upper slip assembly in a closed position, and the lower slip assembly in an open position after the hydraulic cylinders have contacted to lower the pipe into the hole.

The cycle of FIGS. 1 and 2 is repeated until the weight of the drill pipe being forced into the hole overcomes the positive fluid pressure in the well forcing the pipe 25 out of the hole. At that point, there is a negative or downward pressure on pipe 25 as indicated by arrows 34 in FIGS. 3 and 4. Accordingly, the top slips 24 of the lower slip assembly 18 are then engaged to keep the pipe from falling into the hole (FIG. 3). Thereafter, the top slips 20 of the upper slip assembly 16 are engaged and the bottom slips 24 are disengaged in sequence and the hydraulic cylinders 14 are operated to lower the pipe 25 into the well bore (FIG. 4).

During large production runs where considerable lengths of pipe 25 must be run into and out of the well bore 28 under the well pressure conditions described, the cycle of FIGS. 1, 2 and FIGS. 3, 4 is continually repeated. Due to the limitations in size and weight of the snubbing unit for purposes of portability and mounting on the well head 12, the extensible rods 14a have a limited stroke during each cycle. The vertical or axial distance required by slips 20–26 to open and close limit the length of the stroke of the extensible rods 14a which can be effectively used. Thus, by decreasing the vertical or axial distance which the slips 20–26 require for operation, an effectively greater stroke of rods 14a can be utilized for the same overall height of the unit 10. Alternatively, when the vertical height necessary for operation of the slips 20–26 is reduced, the vertical height of the unit 10 may be reduced, thereby making the unit 10 more stable.

Figure 5:
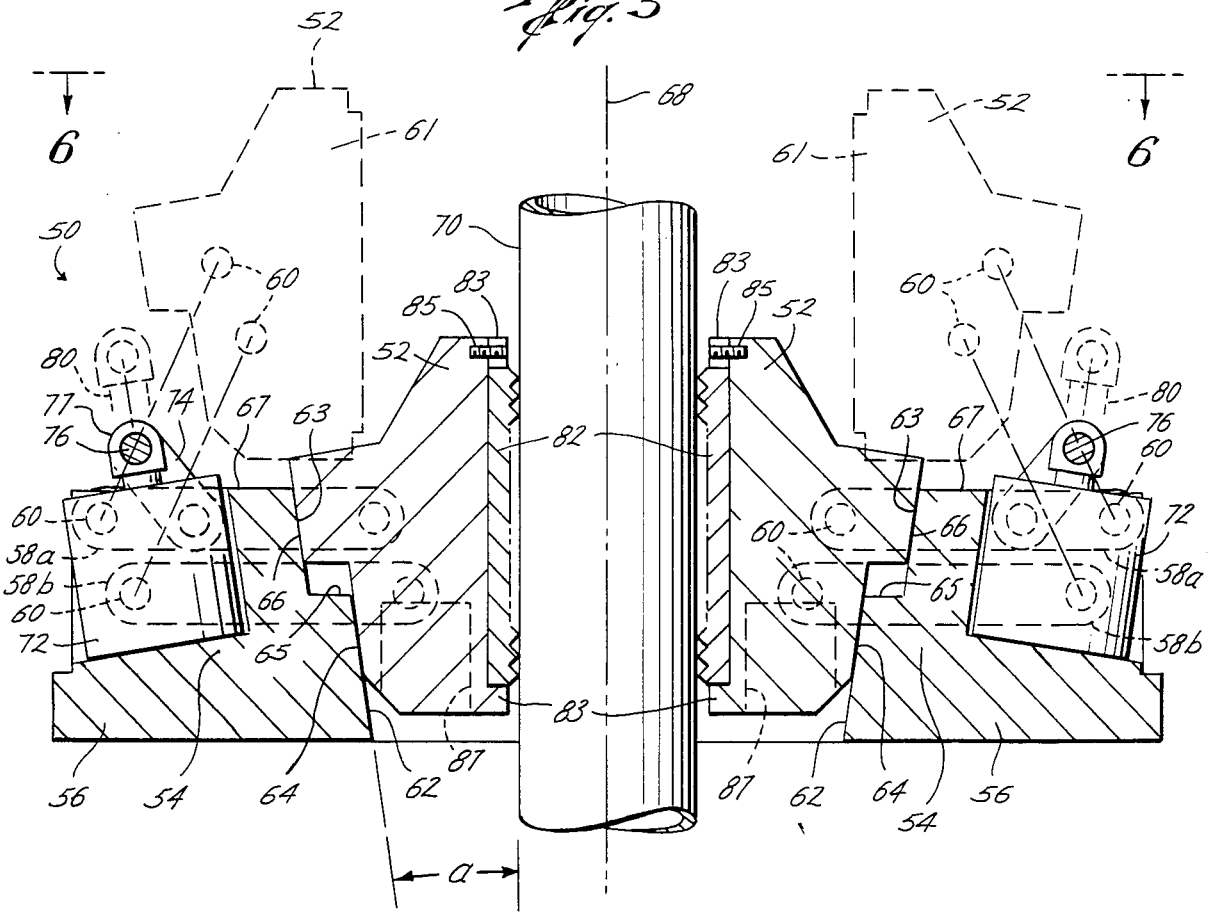
FIG. 5 is a cross-sectional view of the slip assembly of the preferred embodiment of the present invention with the slips shown engaging a pipe in solid lines and disengaged therefrom in dashed lines.
Figure 6:
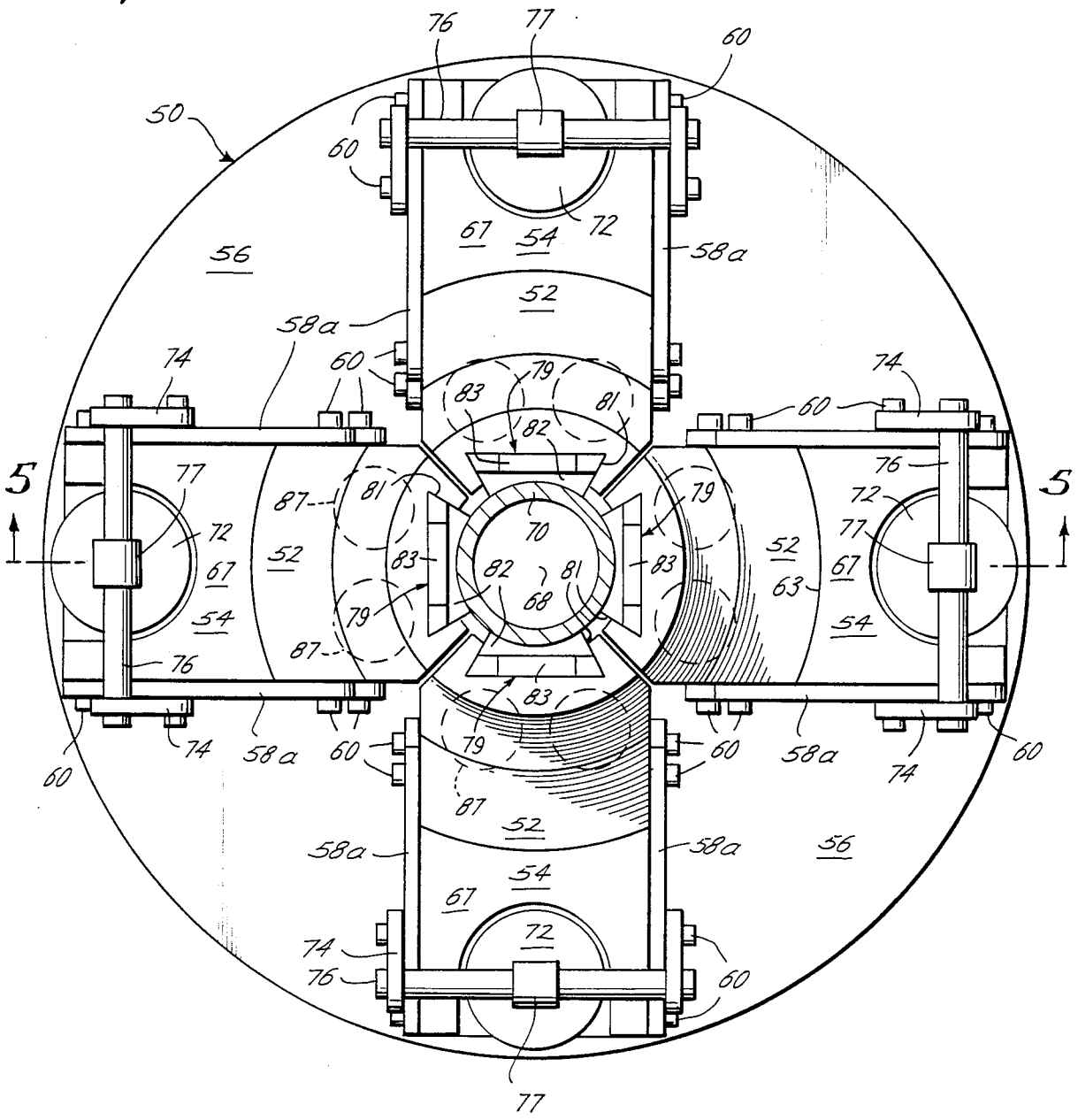
FIG. 6 is a plan view of the slip assembly depicted in FIG. 5.

FIGS. 5 and 6 illustrate the slip assembly 50 of the invention which allows movement of the slips with a reduced vertical travel from the pipe gripping position to the open position, as compared to known prior art devices. Slip assembly 50 generally comprises slip 52 rotatably connected to a slip block or segment 54. Slip block 54 engaged slip 52 along an engaging surface or slip contact surface 62. The slip block 54 mounted to or preferably machined integrally with base plate 56. An additional assembly of slips 52, slip blocks 54, and base plate 56 can be mounted in an upside down position as compared to the slip assembly 50 shown, to provide a duplicate lower slip assembly so that the two assemblies are capable of gripping pipe subjected to both upward and downward forces previously described and as schematically depicted by dual sets 20, 22, and 24, 26 in FIGS. 1 through 4.

The slip 52 is pivotally connected to slip block 54 by parallel links 58a and 58b. Pins or shoulder screws 60 pivotally connect the ends of the parallel links 58a and 58b to the slip 52 and slip block 54. As can be seen in FIG. 6, one set of parallel links 58a and 58b is used on each side 61 of each slip 52 and slip block 54. The pins 60 should be mounted in oversized holes in parallel links 58a and 58b so that a certain amount of movement along the length of the links 58a and 58b between the slip 52 and slip block 54 is possible. The parallel links 58a and 58b are not intended to bear any load from the pipe 70 during engagement of the slip 52. The oversize holes in the parallel links 58a and 58b reduces the possibility that any unintended stress will be placed on the parallel links 58a and 58b and aids in compensating for the use of worn dies 82 or variations in the diameter of tubing 20.

As shown in FIG. 6, the present invention preferably utilizes four slips 52 and slip blocks assemblies 54 radially spaced about the base plate 56 instead of the conventional round slip bowl. This permits parallel links 58a and 58b to be used on the sides 61 of each slip 52 and slip block 54. The use of parallel links 58a and 58b mounted on sides 61 is in sharp contrast to existing mechanical mechanisms for disengaging slips in a conventional slip bowl which have more complicated systems such as dovetail slides or arm mechanisms which must lift the slips out of the round slip bowl from the top. The parallel links 58a and 58b allow movement by simple linkage which can easily be replaced or repaired simply by removing pins 60. In some instances, only three, and possibly only two, slips 52 and blocks 54 may be used.

By way of background prior to discussing further advantages of the present invention, the angle designated as "a" (FIG. 5), of the slip engaging or contact surface 62 prescribed by the American Petroleum Institute and widely used in practice is an engaging angle of "6 to 1". The use of this angle rather than a greater angle prevents the slips from releasing their grip on the pipe under conditions involving high axial loads. This "6 to 1" angle means that a slip must be raised 6 inches axially (vertically) out of a slip bowl to be moved laterally (horizontally) from the pipe one inch.

The lateral and vertical space necessary for operation of the slips 52 is directly related to the arc through which the slips 52 must travel to clear the upper corner 63 between the top surface 67 of slip block 54 and the slip engaging or contact surface 62. To decrease the length of the parallel links 58a and 58b and the diameter of their arc which might otherwise be necessary, the engaging surface 62 along which the slip 52 engages slip block 54 has been divided into two slip surfaces 64, 66 which are offset with respect to each other in parallel relation. The slip surfaces 64, 66 are set at the 6 to 1 angle illustrated as angle a, with respect to the axis 68 of drill pipe 70. The offset slip surfaces or steps 64, 66 have a first top surface 65 and second top surface 67.

The offset or stepped nature of slip surfaces 64, 66 provides several advantages. Initially, the slip 52 can be moved laterally (horizontally) away from the pipe 70 a greater distance than possible using a single slip and block engaging surface with the same angle of the slip and block engaging surfaces 64, 66. Prior slip designs have required that the slip clear the entire slip block before obtaining an equivalent lateral distance from the pipe 70 to that obtained with the present invention. Furthermore, the fact that upper corner 63 is set back further from the pipe 25 than would be possible if a single engaging surface without offsets were used allows the slip 52 to clear slip block 54 through the use of parallel links **58*a* and 58*b* of shorter length than would otherwise be possible. In other words, greater lateral movement of the slips 52 for a given axial movement allows the arc described by parallel links 58*a* and 58*b* to be of shorter radius, thus allowing the parallel links 58*a* and 58*b* to be considerably shorter while still utilizing the 6 to 1 angle on the engaging surface 62 as compared to an arrangement without offset or stepped slip surfaces 64,66**.

Reduced length of parallel links **58*a* and 58*b* allows them to rotate the slips 52 to a full bore opening within the reduced vertical and lateral space available in a snubbing or workover unit. The ability of the slip assembly 50 to operate in a reduced lateral space and a reduced vertical space reduces the size of the snubbing unit and thus renders it more stable in use. Additionally, the offset slip surfaces 64, 66 allows maximum contact surface area between slip 52 and slip block 54 along the engaging surface 62 within a minimum radius of curvature which might be scribed by the parallel links 58*a* and 58*b* during rotation about pins 60 in slip block 54. Maximizing the area of contact along engaging surface 62** minimizes wear.

In the preferred embodiment described herein, rotational forces on the slips are controlled by friction between the slip block 54 and slip 52 along the engaging surface 62, in addition to the parallel links **58*a* and 58*b*. It is possible that in situations involving reduced axial force on the slips which causes less friction along engaging surface 62, such as in shallow wells, a keyway in the engaging surface 62** may be necessary to improve resistance to rotational torque.

Referring to FIG. 5, it can be seen that the uppermost parallel link **58*a* is connected to a piston rod 80 in the hydraulic cylinder 72 by an actuating arm 74 and piston link rod 76. A coupling 77 connects the piston rod 80 to the piston link rod 76. Actuating arm 74 is allowed to rotate about the ends of piston link rod 76. This allows hydraulic operation of the parallel links 58*a* and 58*b*. The actuating arm 74 is pivotally connected by means well known in the art to upper parallel link 58*a* by a pin 60 at a point located between the mid-point of the upper parallel link 58*a* and the end of the upper parallel link 58*a* where it is pivotally connected by pin 60 to slip block 54. The mid-point of upper parallel link 58*a* is considered to be a point about halfway between the pins 60 fastening each end of the upper parallel link 58*a* to the slip 52 and slip block 54. This offset mounting of the actuating arm 74 to the upper parallel link 58*a* allows faster movement of the parallel links 58*a* and 58*b* for a minimal distance of travel of piston rod 80 of hydraulic cylinder 72. In other words, the offset mounting of the actuating arm 74 allows parallel links 58*a* and 58*b* to disengage the slips 52 a maximum distance along an arcuate path with minimum travel of piston rod 80 of hydraulic cylinder 72**.

A dovetail recess 79 with angled sides 81 (FIG. 6) is formed in the slip 52 so that a die 82 for engaging pipe 70 can be slid along the path formed by the recess 79 from the top of slip 52. The lower end of the recess 79 is cast blind, which in combination with the angled sides 81 hold the die 82 in the recess 79. A wedge 83 is used to cap the top end of the recess 79 and it is fastened to the slip 52 by screw 85. Wedge 83 can be removed so that die 82 can be replaced when worn.

As is evident from FIG. 5, slip 52 has surfaces which conform to the slip block 54 along engaging surfaces 62. Phantom lines illustrate the slip 52 in a raised and disengaged position in FIG. 5. Slip 52 is also preferably provided with cavities 87 (dashed lines FIGS. 5 and 6) for weight reduction which extend upward from the bottom of slip 52. The cavities 87 are cylindrical, and may extend from the top to the bottom of the slip. In the preferred embodiment, the cavities extend upwardly through only approximately ⅓ of the depth of the slip 52 to avoid or minimize the collection of debris in the cavities 87.

Shear force caused by axial forces on pipe 70 is transmitted from the slip 52 to slip block 54. Radial stresses are transmitted through slip 52 and slip block 54 to the base plate 56 which restrains the large hoop stresses which can be encountered during workover activities. The ability of the separate components, i.e. the slips 52, slip blocks 54, and base plate 56, to carry separate and distinct loads allows easier repair, assembly and maintenance of the slip assembly 50. Additionally, slips 52 may be readily removed for repair by simply removing pins 60. Dies 82 may be easily changed when worn by removing the upper pin 60 attaching the slip 52 to upper parallel link **58*a*. This allows the slip to rotate about the lower pin 60 connecting the lower parallel link 58*b* to slip 52 such that the die 82** is in a horizontal position allowing complete access and easy maintenance.

The parallel nature of links **58*a* and 58*b* and the location of their mounting by pins 60 to the slip 52 and slip block 54 causes the gripping die 82 and slip 52 to maintain a parallel relationship with the axis 68 of pipe 70 as slip 52 is disengaged and raised from the solid line position to the phantom dash-line position illustrated in FIG. 5. The ability to maintain the die 82 and slip 52 in a parallel orientation during disengagement causes the die 82 to be disengaged from the surface of pipe 70 and the engaging surface 62 in a simultaneous manner. This allows the die 82 to be disengaged from the pipe 70 more efficiently than in prior art devices. Maintaining a parallel orientation of die 82 and the slip 52 relative to the axis of the pipe 70 and the well bore further allows the slip assembly 50 to achieve a full bore opening with a minimum of rotational or translational movement of links 58*a* and 58*b*. The slip 52 and die 82** clear the well bore opening more quickly because of being maintained in such parallel relationship.

The stepped surfaces 64, 66 allow the parallel links **58*a* and 58*b* to be connected to the slip 52 near the vertical mid-portion of the cross-section of the slip 52**

(FIG. 5). In contrast, the connection point of the parallel links 58a and 58b would have to be near the bottom of the slip 52 if offset or stepped slip surfaces 64, 66 were not used. For example, note that the location of the connection pins 160 on slip 152 in the alternate embodiment (FIG. 7) without stepped surfaces 64, 66 are on the lower portion of the cross-section of the slip. It is desirable to locate the connection point of the parallel links 58a and 58b to the slip 52 near the vertical center of the slip in cross-section to facilitate distribution of forces from the slips to the blocks when the slips are gripping the pipe.

FIG. 6 presents the slip assembly 50 in a plan view. Note that FIG. 6 illustrates four assemblies of slips 52 and slip blocks 54 mounted about the central axis 68 of pipe 70. While this is the preferred embodiment, a lesser number of slips 52 and slip blocks 54, but not less than two assemblies, may be utilized. The slips 52 and slip blocks 54 are shown about pipe 70. The engaging surface 62 between slip 52 and slip block 54 is in the form of an arc as viewed in plan in FIG. 6 and is formed in a frusto-conical surface when viewed in three dimensions. FIG. 6 further illustrates the use of cylindrical base plate 56 to withstand radial forces developed as a result of shear stress on the slips 52 and slip blocks 54 imposed by pipe 70.

Figure 8:
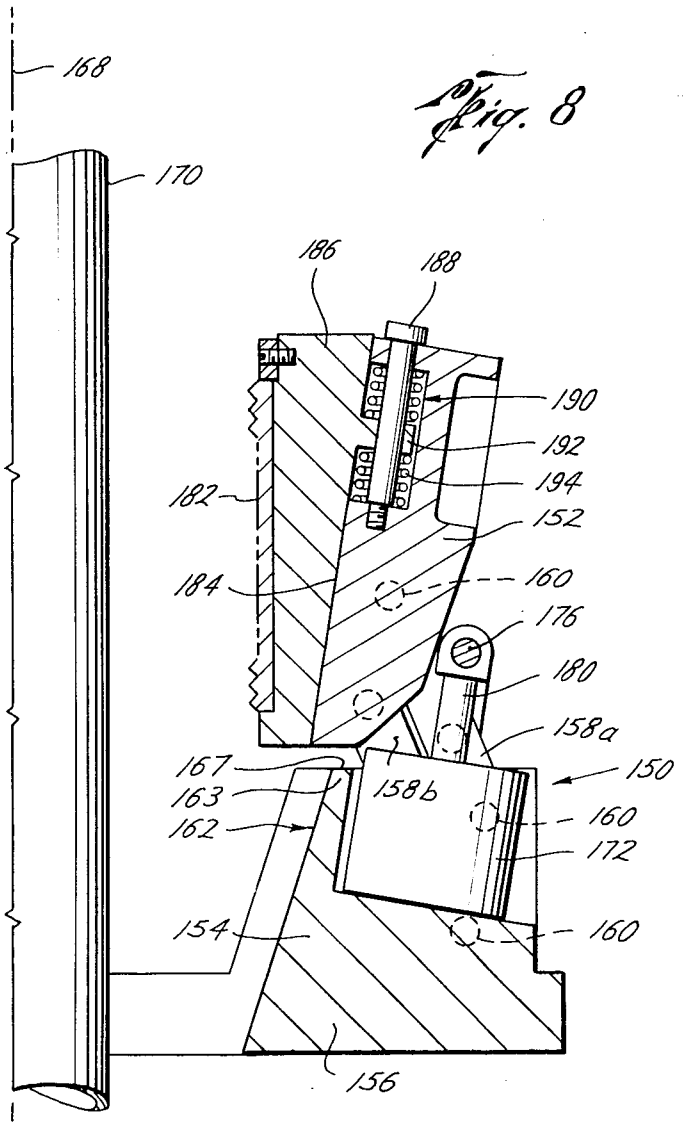
FIG. 8 is a side view in cross-section of the right hand portion of the slip assembly of FIG. 7 in the upper or fully retracted open position.
Figure 7:
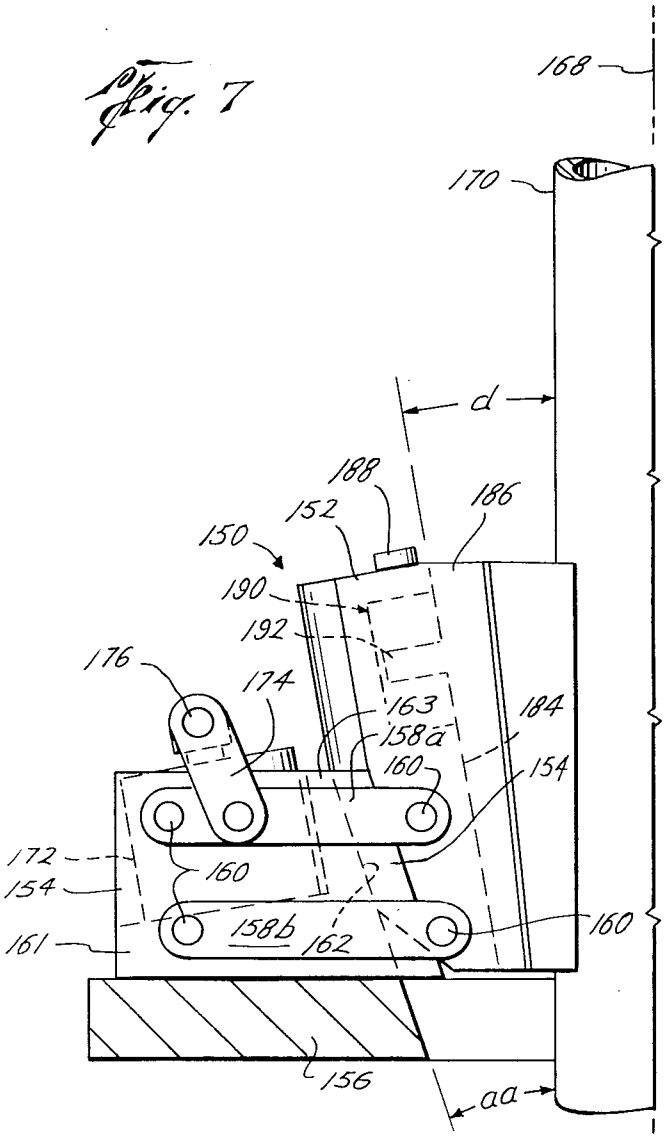
FIG. 7 is a side view of an alternative embodiment of the slip assembly of this invention with the left hand slip shown in gripping engagement with the pipe.

FIG. 7 and FIG. 8 represent an alternative embodiment of the invention. Like parts in FIGS. 4, 6, 7, and 8 are given like reference numerals except that the prefix numeral 1 is used in FIGS. 7 and 8. The alternative embodiment utilizes an engaging surface 162 having an angle "aa" which is greater than the angle a of FIG. 5 with respect to the axis 68 of the pipe 70. Also, such embodiment has a die surface 184 having a decreased angle with respect to the axis 68 of the pipe 70, designated angle "d". The stepped or offset slip surfaces 64, 66 illustrated in FIG. 5 are replaced by such combination of surfaces, so that the slips function with only a single block surface 162, as more fully explained. By increasing the angle of engaging surface 162, the top of the slip block, i.e. corner 163, 167 are set back a greater distance from pipe 170 than would be possible with a single engaging surface with a normal 6 to 1 angle. This allows slip 152 to be withdrawn from pipe 170 by the parallel links 158a and 158b a maximum lateral distance within a minimum axial or vertical distance.

The slip assembly 150 has slip 152 pivotally connected to slip block 154 by parallel links 158a and 158b and pins 160. Parallel links 158a and 158b, and pins 160 allow the slip 152 to be rotated to a position in which they are disengaged from pipe 170 as illustrated in FIG. 8. The parallel links 158a and 158b further allow slip 152 and die 182 to maintain a parallel relationship to the axis 168 of pipe 170 as the slip 152 is disengaged. In other words, the surface of die 182 is maintained in parallel relationship during disengagement to the surface of die 182 during engagement with pipe 170 in a manner similar to the preferred embodiment of FIGS. 5 and 6.

The length of parallel links 158a and 158b are reduced to a minimum without reducing the vertical height of the slip block 154 because engaging surface 162 between the slip 152 and slip block 154 has been increased from a 6 to 1 angle to an angle of approximately 30°–45°. This allows the slip 152 to clear the corner 163 of slip block 154 as it is rotated during disengagement by parallel links 158a and 158b without significantly increasing the length of parallel links 158. As noted above, the decreased length of parallel links 158 allows the width or lateral size of the entire snubbing unit to be kept to a minimum.

The angle of the engaging surface 162 with respect to the axis 168 of the drill pipe 170, angle aa, may be increased to 60° or more. However, the preferred angle of the engaging surface 162 to the axis 168 of pipe 170 is considered to be on the order of 30°.

To compensate for the increased angle of the engaging surface 162 to the vertical, angle aa, the die 182 has been attached to a die unit 186 which floats on the surface of slip 152 on die surface 184. Die surface 184 is set at an angle of 6 to 1 with respect to the vertical or the central axis 168 of pipe 170, designated angle d in FIG. 7. The use of the die surface 184 allows the use of an increased angle on the engaging surface 162, angle aa, while maintaining sufficient lateral pressure on pipe 170 to prevent the pipe from moving in an axial direction when the slips are in the engaged position with the pipe 170.

Note that die unit 186 is attached to slip 152 such that it is free to slide in a vertical direction along die surface 184. The angle d of the die surface 184 to the vertical allows some lateral movement of the die unit 186 as the die unit 186 slides in a vertical direction. This lateral movement allows worn dies 182 of varying thickness to be used and also allows dies 182 to engage used or worn pipe 170 which may be scored or of a varying diameter.

Die unit 186 is attached to slip 152 by bolt 188. A recess 190 is formed in the surface of slip 152 which engages die unit 186 along die surface 184. A tab 192 on the back of die unit 186 fits within the recess 190 along with a spring 194. Bolt 188 passes through holes in slip 152, through spring 194 and through a hole in tab 192 such that it locks the tab 192 and spring 194 in recess 190. Tab 192 restrains die unit 186 such that it travels along the axis of the bolt 188 and surface 184 in a vertical manner as slip 152 and die 182 are lowered into engagement with pipe 170. Die unit 186 can travel along die surface 184 to achieve further wedging action in addition to wedging action provided by engaging surface 162. Spring 194 allows the die unit 186 to return to a neutral position along die surface 184 and slip 152 wherein the spring forces above and below tab 192 are equalized upon disengagement of die 182 from pipe 170. A floating die unit 186 may be used in conjunction with the slip 52 of FIGS. 5 and 6 or any other slip to facilitate the use of worn dies.

The split and segmented structure of each slip block 54 from other slip blocks 54 in the preferred embodiment of FIGS. 5 and 6, as previously explained, allows the use of mechanical links 58a and 58b affixed to the sides 61 of the slips 52 and the same advantage is present in the alternative embodiment of FIGS. 7 and 8. This allows greater control and reliability of operation. Also, the use of stepped or offset surfaces 64, 66 (FIGS. 5 and 6) or a combination of die and engaging surfaces 162, 184 (FIGS. 7 and 8) allows the slip 52 to be translated or rotated between engaged and disengaged positions through the use of shorter links 58a and 58b. This decreases the axial and lateral space required for slip 52 operation and enhances the portability and effective working length of the overall snubbing or workover unit. The slip assemblies 50, 150 of the present invention can be used in any position or orientation and do not require complex machining or complex multiple parts. The slip assemblies 50 of the present invention can open to a full bore position during normal operation without any disassembly of the slips 52 or removal of the slips 52 from the slip blocks 54.

By way of example, so far as is known, prior slip assemblies generally required at least 15 inches of vertical height to engage and disengage. Slips of the present invention require only about 12 inches of vertical height for complete operation. This represents a decrease in the overall height of the workover unit where two dual slip assemblies such as 20, 22 and 24, 26 are used, as compared to the working length of a normal snubbing unit.

For purposes of reference and definition, the angle of the engaging surface 62 of the slip block 54 may be defined with respect to the vertical, or with respect to the intended longitudinal axis 68 of the pipe 70. It is assumed that under normal circumstances, the pipe will be in a vertical orientation such that the axis 68 is vertical. The angle between the engaging surface 62 and the axis of the pipe is defined as the slip angle a. The corresponding angle in the alternative embodiment is angle aa. The upper portion of the engaging surface 62 assumes the slips 54 to be in an "upright" orientation of FIGS. 5, 7, and 8. In FIG. 5 the upper portion would be an area of the engaging surface 62 approximating the area of slip surface 66. The upper portion of the engaging surface 162 would approximate the upper half of the engaging surface 162. A feature of the invention allows the upper portions of the engaging surfaces 62, 162, i.e. corners 63, 163, to be located a greater lateral distance from the vertical axis 68 of the pipe 70 than prior art devices so that the arc through which the parallel links 58*a*, 58*b* and 158*a*, 158*b* rotate is reduced. Correspondingly, the length of the parallel links 58*a* and 58*b* is reduced.

The forgoing disclosure and description of the invention are illustrative and explanatory thereof, and various changes in the size, shape and materials, as well as in the details of the illustrated construction may be made without departing from the spirit of the invention.

We claim:

1. A slip assembly adapted to engage pipe for movement of pipe into or out of a well bore comprising:

a slip having a pipe engaging surface and a slip block contact surface;

a slip block which engages the slip along a slip contact surface that is angled with respect to the pipe engaging surface;

parallel vertically spaced links which pivotally connect the slip and slip block for movement of the slip into engagement with the slip block along said contact surfaces, each link having a first end pivotally connected to the slip and a second end pivotally connected to the slip block; and which, during both engagement and disengagement of the pipe engaging surface of the slip with the pipe, maintains said pipe engaging surface substantially parallel to the axis of the pipe; and actuating means for pivoting the link to move the slip relative to the slip block, said actuating means being pivotally connected to said link between the second end of the link and the mid-point of the link between the pivotal connections on the first and second ends of the link.

2. The slip assembly of claim 1, wherein:

said slip and slip block have a left and right side, and in which a first set of vertically spaced parallel links is connected to the left side of the slip and slip block, and a second set of parallel links is connected to the right side of the slip and slip block.

3. The slip assembly of claim 2, wherein:

said actuating means is connected by an actuating arm to at least one link on the left and right side of the slip and slip block respectively.

4. The slip assembly of claim 1, wherein the actuating means includes a hydraulic cylinder.

5. The slip assembly of claim 1, wherein three slip assemblies are mounted to a base plate and positioned about a central axis to engage a pipe.

6. The slip assembly of claim 1, wherein four slip assemblies are mounted to a base plate and are positioned about a central axis to engage a pipe.

7. The slip assembly of claim 1, wherein the slip contact surface of the slip block comprises:

at least two slip surfaces which are offset in parallel planes with respect to each other and which conform with the slip block contact surfaces on the slips to allow the slips to move laterally with parallel links of minimum length while maintaining a small enough angle between the contact surface and the longitudinal axis of the pipe to assure gripping support of the pipe.

8. The slip assembly of claim 2, wherein the slip has a die surface and the pipe engaging surface is formed by a die and mounting member therewith which are slidably connected to the slip so that they move axially along the die surface of the slip, said die surface being angled with respect to the pipe engaging surface so that the slip and die can engage used and scored pipe, and accomodate worn die surfaces under high stress conditions.

9. The slip assembly of claim 8, wherein the angle between the slip contact surface and the vertical is greater than 6 to 1 to allow the slips to move laterally with parallel links of minimum length.

10. The slip assembly of claim 9, wherein the angle between the slip contact surface and the vertical is approximately 30°.

11. The slip assembly of claim 9, wherein the die is connected to the slip by a spring means which allows the die to move along a die surface between the slip and die during engagement and return to its initial position during disengagement.

12. The slip assembly of claim 9, wherein a plurality of slip assemblies are mounted about a central axis to a base plate to engage pipe.

13. A slip assembly adapted to engage pipe for movement of pipe in a well bore comprising:

a plurality of slips each having a pipe engaging surface and a slip block engaging surface;

a plurality of slip blocks connected to a base plate and adapted to be positioned radially about a pipe, each slip block having a slip engaging surface for engaging the slip;

a plurality of vertically spaced parallel links pivotally connecting each slip with a corresponding slip block for engaging and disengaging the slip from the slip block while maintaining the pipe engaging surfaces substantially parallel to the axis of the pipe at all times, each link having a first end pivotally connected to the slip and a second end pivotally connected to the slip block; and a plurality of actuating means for pivoting the links to move the slips relative to the slip blocks, each of said actuating means being pivotally connected to at least one link between the second end of the link and the mid-point of the link between the pivotal connections on the first and second ends of the links.

14. The slip assembly of claim 13, wherein:

each slip and slip block have left and right sides;

a first set of said parallel links connected to the left side of each slip and slip block; and a second set of said parallel links connected to the right side of each slip and slip block.

15. The slip assembly of claim 13, wherein the slip engaging surface of each slip block comprises:

at least two slip surfaces which are offset in parallel planes with respect to each other and conform with the corresponding slip block engaging surface to allow the slip to move laterally during disengagement and engagement with parallel links of minimum length while maintaining a small enough angle between each slip surface and the longitudinal axis of the pipe to assure gripping support of the pipe.

16. The slip assembly of claim 13, wherein:

the slip has a die surface and the pipe engaging surface is formed by a die slidably connected to the slip so that it moves vertically along the die surface of the slip;

said die surface being angled with respect to the pipe engaging surface so that the slip and die can engage used or scored pipe of varying diameter and accommodate worn die surfaces, and so the die engaging surface and the slip engaging surface act to reduce the tendency of each slip to release its gripping engagement with the pipe.

17. The slip assembly of claim 13, wherein the angle between the slip engaging surface and the vertical is greater than 6 to 1 to allow the slip to move laterally with parallel links of minimum length.

18. The slip assembly of claim 17, wherein the angle is approximately 30°.

* * * * *